US011043057B2

(12) United States Patent
Schmützmann et al.

(10) Patent No.: US 11,043,057 B2
(45) Date of Patent: Jun. 22, 2021

(54) MAGNETIC TESTING OF VALUABLE DOCUMENTS

(71) Applicant: GIESECKE+DEVRIENT CURRENCY TECHNOLOGY GMBH, Munich (DE)

(72) Inventors: Jürgen Schmützmann, Pfaffenhofen (DE); Helmut Pradel, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 157 days.

(21) Appl. No.: 16/488,803

(22) PCT Filed: Feb. 28, 2018

(86) PCT No.: PCT/EP2018/000080
§ 371 (c)(1),
(2) Date: Aug. 26, 2019

(87) PCT Pub. No.: WO2018/157970
PCT Pub. Date: Sep. 7, 2018

(65) Prior Publication Data

US 2021/0074108 A1 Mar. 11, 2021

(30) Foreign Application Priority Data

Feb. 28, 2017 (DE) ..... 10 2017 001 947.9

(51) Int. Cl.
*G07D 7/04* (2016.01)
*G07D 11/17* (2019.01)

(52) U.S. Cl.
CPC ..... *G07D 7/04* (2013.01); *G07D 11/17* (2019.01)

(58) Field of Classification Search
CPC ..... G07D 7/00; G07D 7/04; G07D 2207/00; G07D 2211/00; G07D 7/004; G06K 7/08; G06K 7/087
See application file for complete search history.

(56) References Cited

U.S. PATENT DOCUMENTS 8,622,389 B2 1/2014 Schutzmann et al.
10,002,267 B2 * 6/2018 Schutzmann ..... G06K 19/06
(Continued)

FOREIGN PATENT DOCUMENTS

DE 10256235 A1 6/2004
DE 102005000698 A1 7/2006
(Continued)

OTHER PUBLICATIONS

German Search Report from DE Application No. 102017001947.9, dated Sep. 20, 2017.
(Continued)

*Primary Examiner* — Thien M Le
*Assistant Examiner* — April A Taylor
(74) *Attorney, Agent, or Firm* — Workman Nydegger

(57) ABSTRACT

A method for checking of magnetic properties of value documents with the aid of a magnetic sensor comprises a measuring sensor row having a plurality of magneto-sensitive measuring sensor elements, as well as at least one further magneto-sensitive sensor element which is arranged behind the measuring sensor elements and has a greater distance from the transport plane of the value document than the measuring sensor elements. By means of the further sensor elements, correction signals are detected at correction measuring points of the value document, which are disposed on the same measuring line as the measuring points. In order to eliminate the distance dependence of the measuring signals, the respective measuring signal of each measuring
(Continued)

point is corrected on the basis of the signal drop which the correction signal ascertained for this measuring point has in comparison to the measuring signal of the respective measuring point.

15 Claims, 4 Drawing Sheets

(56) References Cited

U.S. PATENT DOCUMENTS

| | | | |
|---|---|---|---|
| 2004/0130318 | A1 | 7/2004 | Saltsov et al. |
| 2011/0090546 | A1 | 4/2011 | Schutzmann et al. |
| 2016/0155282 | A1 | 6/2016 | Miura et al. |

FOREIGN PATENT DOCUMENTS

| | | | |
|---|---|---|---|
| EP | 2304699 | B1 | 1/2013 |
| WO | 2004055739 | A1 | 7/2004 |

OTHER PUBLICATIONS

International Search Report from PCT Application No. PCT/EP2018/000080, dated Jun. 13, 2018.

* cited by examiner

MAGNETIC TESTING OF VALUABLE DOCUMENTS

BACKGROUND

The invention relates to a method and a magnetic sensor for the magnetic checking of value documents.

Value documents generally have various security features to make their forgery more difficult or which are specific to the particular value document type. The authenticity of a value document or the value document type is checked with special checking apparatus, which comprise a detector arrangement and a transport device, which guides the value document past the detector arrangement. The detector arrangement ascertains measurement values at many measuring points on the surface of the value document, which measurement values represent certain properties of its security features. The ascertained measurement values are then employed to check the authenticity of the document, and, for example, compared with reference values for this purpose.

However, the measurement values can be falsified by the circumstance that the distance between the value document and the detector fluctuates. Usually, this relationship is such that the measuring signal decreases with increasing distance between detector and measuring point. This distance can change not only from one value document to the next, but can also change within a value document, so that consecutively checked measuring points of the same value document occupy different distances from the detector. This varying distance is caused, for example, by kinking and curling of the document, in particular in the case of used banknotes, or else by fluttering of the value documents during rapid guiding through the checking apparatus.

In order to avoid false checks, it is desirable upon the checking of magnetic properties to limit the dependence of the measurement results on the distance between the value document and the detector as far as possible. However, especially when distances of the value document from the detector are small, the distance dependence of the magnetic measuring signal becomes particularly strongly noticeable.

It has therefore been proposed in DE 102 56 235 A1 to stabilize a value document during transport through the checking apparatus, for example by roller-belt systems or pressure and suction systems or the like, in order to minimize the variation of the distance in this manner. However, this results in obvious disadvantages due to high wear and/or the constructively highly complex and correspondingly repair-prone system components.

From EP 2304699 B1 a guide element is known, with which likewise a mechanical stabilization of the value document is achieved in order to reduce distance fluctuations of the value document from the magnetic sensor.

Moreover, it is known from DE 101005000698 Al to measure the distance with the aid of an additional sensor and to correct the measuring signals on the basis of the measured distance. However, this additional sensor is complex and requires a lot of space.

SUMMARY

Accordingly, it is the object of the present invention to propose a simpler solution in order to obtain results upon the checking of the magnetic properties of value documents which are not falsified by the varying distance to the detector.

In order to check magnetic properties of the value document, in particular of a security element of a value document, the value document is transported past a magnetic sensor along a transport direction. The magnetic sensor has, transversely to the transport direction of the value document, i. e. perpendicularly or obliquely to the transport direction of the value document, a measuring sensor row with a plurality of magneto-sensitive measuring sensor elements, which are arranged at a target distance to a transport plane of the value document. Further, the magnetic sensor has at least one further magneto-sensitive sensor element, preferably at least two further magneto-sensitive sensor elements, which, viewed from the value document transported past, is/are arranged behind the measuring sensor row along a line parallel to the measuring sensor elements, and which has/have a larger distance from the transport plane of the value document than the measuring sensor elements. The magneto-sensitive measuring sensor elements and the magneto-sensitive further sensor element(s) will be referred to in the following simply as measuring sensor elements and further sensor elements.

By means of the measuring sensor elements, measuring signals of the value document are detected at a plurality of measuring points of the value document, which are arranged on the value document along a measuring line transversely to the transport direction. By the further sensor element(s) a correction signal or correction signals is/are respectively detected at a respective correction measuring point of the value document, which is or are disposed on the same measuring line as the measuring points. In order to eliminate the distance dependence of the measuring signals, the measuring signals detected at the measuring points are corrected with the aid of the correction signal(s) detected at the correction measuring point(s). The measuring signals of the measuring points corrected in this manner are employed for checking the magnetic properties of the value document. Preferably, the correction signals of the correction measuring points are detected simultaneously with the measuring signals of the measuring points in order to be able to carry out the most accurate distance correction possible.

For correcting the measuring signals detected at the measuring points, the respective measuring signal is compared with the respective correction signal. Due to the greater distance of the at least one further sensor element from the value document in comparison to the measuring sensor elements, the correction signal is lower than the measuring signal of the respective measuring point. The respective measuring signal of the respective measuring point is corrected on the basis of the signal drop which the correction signal ascertained for this measuring point has in comparison to the measuring signal of the respective measuring point.

From the detected correction signal(s) which is/are detected at the respective correction measuring point, a correction signal can be ascertained for the respective measuring point of the measurement line at which the measuring sensor elements have detected the respective measuring signal. The expression "correction signal ascertained for the measuring point" includes the case that the correction measuring point and the measuring point on the value document are identical, but also includes the case that the correction measuring points are not identical with the measuring points, but the measuring signal of a measuring point is corrected with the aid of the correction signal(s) of one/a plurality of correction measuring point(s) adjacent, for example disposed closest on the value document, to the respective measuring point. The correction signal of a further sensor element is employed, for example, to correct the measuring signals of a plurality of measuring points that are disposed in the vicinity of the correction measuring point of this further sensor element.

In order to correct the measuring signals detected at the measuring points of the value document, the respective measuring signal of a measuring point is compared with the correction signal ascertained for this measuring point, for example by computing the ratio of correction signal and measuring signal. Based on the signal drop which the correction signal ascertained for this measuring point has in comparison to the measuring signal of the respective measuring point (for example based on the ratio between the measuring signal of the respective measuring point and the correction signal ascertained for this measuring point), subsequently the (local) distance of the respective measuring point of the value document from the respective measuring sensor element is computed. With the aid of the ascertained (local) distance of the value document from the measuring sensor element, the respective measuring signal detected by the respective measuring sensor element at the respective measuring point is corrected, in particular making use of a known distance dependence of the measuring signal. The corrected measuring signal of the respective measuring point is determined, for example, by integrating the distance ascertained for the respective measuring point into the distance dependence of the measuring signal ascertained before the value document check.

The correction is carried out qualitatively such that the measuring signal of the measuring sensor elements is corrected upward, if the ascertained distance exceeds the target distance that the transport plane of the value document has to the measuring sensor elements, and is corrected downward, if the ascertained distance undershoots the target distance. The dimension of this correction depends on the ratio of the respective measuring signal of a measuring point to the correction signal ascertained for this measuring point. The corrected measuring signal corresponds, for example, to the measuring signal that would be detected by the measuring sensor elements at the target distance of the value document from the measuring sensor elements.

The mentioned distance dependence can be known, for example, from a data sheet of the measuring sensor elements or can have been ascertained on the basis of its data. However, it can also have been simulated or ascertained empirically for the measuring sensor elements before the value document check. For example, before the value document check a distance dependence is ascertained for the measuring sensor elements of the magnetic sensor which reproduces the progression of the measuring signal of the measuring sensor elements in dependence on the distance between the value document and the measuring sensor elements. In the same manner, a (further) distance dependence is ascertained for the at least one further sensor element which reproduces the progression of the correction signal in dependence on the distance between the value document and the measuring sensor elements. For example, the dependence of the distance on the ratio between the correction signal and the measuring signal is determined from the progression of the measuring signal and the progression of the correction signal in dependence on the distance.

The ascertained distance is a local distance insofar as it is valid only individually for the respective measuring point, wherein the distances ascertained for different measuring points normally differ from one another. To correct the respective measuring signal, the individual distance ascertained for the respective measuring point can be inserted into the known distance dependence of the measuring signal in order to ascertain a correction factor that is applicable individually to the respective measuring point and that is offset against the measuring signal of the respective measuring point. Correspondingly, the correction factor for the respective measuring point is also individual, wherein the correction factors for the different measuring points normally differ from one another.

The corrected measuring signal of the respective measuring point can be determined by integrating the distance of the measuring point ascertained for the respective measuring point into the distance dependence of the measuring signal of the measuring sensor elements that is known, for example ascertained before the value document check, in order to ascertain a correction factor that is applicable individually to the respective measuring point. The respective measuring signal of the respective measuring point can subsequently be multiplied by the correction factor ascertained for the respective measuring point in order to obtain the corrected measuring signal.

To compare the respective correction signal with the respective measuring signal, the ratio between the respective correction signal and the respective measuring signal is preferably formed. From the ratio between the respective correction signal and the respective measuring signal, the distance of the respective measuring point of the value document from the respective measuring sensor element is ascertained with the aid of the known distance dependence of the ratio. From this distance, which was ascertained individually for the respective measuring point of the value document, a local correction factor is ascertained for the respective measuring point of the value document. To correct the measuring signal, the measuring signal of the respective measuring point is offset against the respective local correction factor (for example multiplied or divided), which was ascertained for the respective measuring point.

However, the correction of the detected measuring signal is preferably carried out only for such measuring signals of the security element to be checked which reach or exceed a predetermined threshold. An otherwise erroneous correction is thus avoided. For with reference to the correction, such cases are ignored in which very low measuring signals, which are falsified by noise or interference, for example, would be offset to form nonsensical values due to (even lower and likewise falsified) correction signals. Those measuring signals which undershoot the predetermined threshold are not corrected and are not employed for checking the magnetic properties of the security element either.

In the magnetic sensor, the number of further sensor elements is preferably smaller than the number of measuring sensor elements, in particular smaller by at least a factor of 2. For example, the measuring sensor elements can be regularly arranged at 2 mm intervals away from each other and the further sensor elements at 10 mm intervals from each other. It has namely been found that the value document distance from the magnetic sensor usually changes significantly only at a length of several mm (viewed perpendicularly to the transport direction). Due to the smaller number of correction sensor elements in comparison to the measuring sensor elements, a distance correction is possible with less effort. The measuring signal of those measuring sensor elements which are disposed along the measuring line between two of the further sensor elements can be corrected with the aid of the correction signals of the further sensor elements most closely adjacent to these measuring elements.

In particular, the density of the further sensor elements of the magnetic sensor in the direction perpendicular to the transport direction of the value document is chosen such that the magnetic sensor has at least one further sensor element for every 20 mm section of the value document perpendicular to the transport direction of the value document. Thus, the number of further sensor elements is adjusted to the characteristic length perpendicular to the transport direction at which the distance of the value document from the magnetic sensor changes.

The measuring signal of the measuring points of such measuring sensor elements, behind which no further sensor element is arranged, is preferably corrected with the aid of the correction signals of at least two correction measuring points. To correct the measuring signal of these measurement sensor elements, the correction signals of the further sensor elements or values derived from these correction signals (for example the distance) can be interpolated (interpolation in the y direction). For example, the correction signal itself is interpolated and then employed to correct the measuring signals of the intermediate measuring sensor elements. In this case, a fit of the correction signals of these measuring points (in the case of more than two correction measuring points in particular a polynomial fit) can be carried out along the measuring line. Thus, a correction signal can be generated for those measuring sensor elements behind which no further sensor element is arranged. Alternatively, however, the local distance of the correction measuring points of the value document from the measuring sensor elements can first be ascertained from the correction signal and subsequently, by interpolating the distance values, also for the intermediate measuring sensor elements (behind which no further sensor element is arranged) the local distance of the value document can be determined respectively.

Further, in the case of a security element extended in the transport direction, such as in a motif or image printed with magnetic ink, for example, also an interpolation of the correction signals or of the values derived therefrom (for example distance values) in the transport direction (x-direction) is preferred. In such a security element, the measuring signals of measuring points of a two-dimensional section (ROI) of the value document are detected during the transporting past of the value document, said two-dimensional section extending both perpendicularly to and along the transport direction. The measuring signals of measuring points of this two-dimensional section (ROI) are preferably compared with a minimum value. For example, the minimum value is higher than the above-mentioned threshold (below which the measuring signal is ignored). The measuring signal of such a measuring point whose measuring signal reaches or exceeds the minimum value is corrected by the correction signal detected at the respective measuring point or at the most closely adjacent correction measuring point. However, the measuring signal of such a measuring point whose measuring signal undershoots the minimum value (but exceeds the above-mentioned threshold) is corrected with the aid of the correction signals of at least two, preferably at least three, correction measuring points of this two-dimensional section (ROI). Their correction signals are interpolated for this purpose to ascertain an interpolated correction signal for the respective measuring point.

In particular, for this purpose the correction signals of at least two correction measuring points of this two-dimensional section are interpolated, which are shifted along the transport direction with respect to the respective measuring point. For example, one of the correction measuring points—viewed in the transport direction of the value document—is chosen at the beginning of the ROI and a further correction measuring point at the end of the ROI. The interpolation of a plurality of correction signals in the case of low measuring signals has the advantage that also low measurement values are taken into account for checking the two-dimensional security element, but their (incorrect) correction with a single very small correction measurement value detected for these measuring points is avoided. In addition, one or a plurality of further correction measuring points of this two-dimensional section (ROI) which are shifted perpendicularly or obliquely to the transport direction with respect to the respective measuring point can be employed for the interpolation.

From the correction signals of two or more than two correction measuring points, an average distance of the two-dimensional section (ROI) from the measuring sensor elements can be ascertained that is valid for the two-dimensional section (ROI) as a whole. Then, the measuring signals of all measuring points of this two-dimensional section (ROI) can be corrected with the aid of this average distance of the two-dimensional section (ROI).

The invention also relates to a magnetic sensor for checking magnetic properties of the value document. The magnetic sensor contains the above-mentioned measuring sensor row, which has a plurality of magneto-sensitive measuring sensor elements arranged at a target distance to the transport plane of the value document, and which has the further magneto-sensitive sensor element(s) which is/are arranged behind the measuring sensor row with reference to the value document transported past, along a line parallel to the measuring sensor elements, and which has/have a greater distance from the transport plane of the value document than the measuring sensor elements.

For example, the measuring sensor elements and the at least one further sensor element are arranged on the mutually opposing sides of the same carrier. Since their distance from each other is thus particularly well defined, the distance correction is more accurate as well.

The measuring sensor elements and the at least one further sensor element preferably employ the same measuring principle. Since these employ the same measuring principle, all magnetic influences, such as, for example, magnetic field disturbances, which influence the measuring signal of the measuring sensor elements, act in a similar manner on the measuring signal of the further sensor element(s). Since magnetic disturbances have the same effect on both, a particularly accurate distance correction can be achieved with the further sensor element(s) which employ the same measuring principle. Preferably, the measuring sensor elements and the further sensor element(s) are identically constructed. The measuring signals of the measuring sensor elements and of the further sensor element(s) are then different only due to the different distance to the value document. This makes possible a particularly accurate correction of the distance dependence.

Further, the magnetic sensor contains a control device adapted to control the measuring sensor row such that the measuring sensor elements detect measuring signals of the value document at a plurality of measuring points of the value document, which are arranged on the value document along a measuring line transversely to the transport direction, and to control the further sensor element(s) in such a manner that it/they detect(s) a correction signal at the respective correction measuring point of the value document which is/are disposed on the same measuring line. The control device controls the measuring sensor row and the further sensor element(s) in accordance with the method described above and for this purpose has corresponding software in order to carry out the method described above.

Further, the magnetic sensor has an evaluation device adapted to correct the measuring signals detected at the measuring points of the value document with the aid of the correction signal(s) detected at the correction point(s) of the value document, thereby to eliminate the distance dependence of the measuring signals, and to check the value document on the basis on the corrected measuring signals of a plurality of the measuring points. The evaluation device can be accommodated in the housing of the magnetic sensor, but it can also be arranged outside thereof. The evaluation device and the control device can be combined in one device.

The evaluation device is adapted to evaluate the detected measuring signals and correction signals in accordance with the method described above and has corresponding software for this purpose. The evaluation software carries out the described distance correction and the check of the magnetic properties of the value document.

The invention also relates to an apparatus for checking magnetic properties of a value document. This can be a value document processing apparatus, in particular a checking apparatus or a sorting apparatus for value documents, or a depositing and/or dispensing apparatus for value documents. The apparatus has the above-described magnetic sensor, as well as optionally also further sensors, and a transport device for transporting the value document in the transport plane along a transport direction, which transports the value documents to be checked individually one after the other past the magnetic sensor.

BRIEF DESCRIPTION OF THE DRAWINGS

Further advantages, features and application possibilities of the present invention will result from the following description in connection with the figures. There are shown.

DETAILED DESCRIPTION OF VARIOUS EMBODIMENTS

Figure 1A:
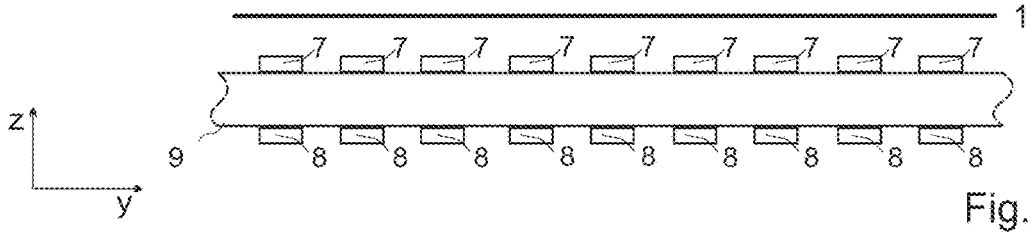
FIG. 1*a* a first example of a measuring sensor row and further magneto-sensitive elements of a magnetic sensor in cross section, FIG. 1*b* a second example of a measuring sensor row and further magneto-sensitive sensor elements of a magnetic sensor in cross section, FIG. 2 check of a value document with the aid of a magnetic sensor having two measuring sensor rows, FIG. 3 a value document at an irregular distance to the magnetic sensor, FIG. 4*a* progression of the sensor signals of the measuring sensor elements (M) and of the further sensor elements (K) ascertained before the value document check, as a function of the value document distance, FIG. 4*b* ratio of the sensor signals of the measuring sensor elements (M) and the further sensor elements (K) as a function of the value document distance, FIG. 5*a* the progression of the measuring signal of the measuring sensor elements detected from the value document, FIG. 5*b* the progression of the correction signal of the further sensor elements detected from the value document.

In FIG. 1*a* a measuring sensor row of a magnetic sensor 10 with magneto-sensitive measuring sensor elements 7 is shown. For each of the measuring sensor elements 7, the magnetic sensor also has in each case a further magneto-sensitive sensor element 8, which is arranged behind the magneto-sensitive sensor elements 7 with reference to the value document BN. The sensor elements 7 and 8 are arranged on the same substrate 9, for example on a circuit board, which also makes available the electrical connections to the sensor elements.

Figure 1B:
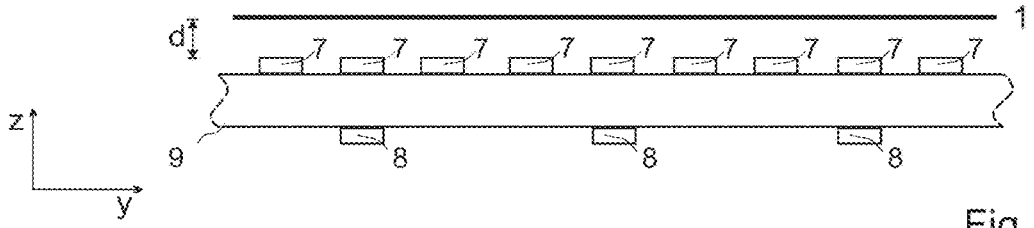

FIG. 1*b* shows a second example of a measuring sensor row of a magnetic sensor with magneto-sensitive measuring sensor elements 7 and further magneto-sensitive sensor elements 8 on the same substrate 9. In this example, however, there are fewer further magneto-sensitive sensor elements 8 than measuring sensor elements 7. For this case, if there is not actually a further sensor element 8 present for each measuring point, i. e. if the number of further sensor elements is smaller than the number of measuring sensor elements, one and the same further sensor element 8 can be employed to correct the measuring signal of a plurality of measuring sensor elements 7, i. e. a plurality of measuring points on the value document. In this case, the correction signal of the respective further sensor element 8 is assigned to the measuring signals of those measuring sensor elements 7 which are arranged most closely adjacent to the respective further sensor element along the y-direction.

Figure 2:
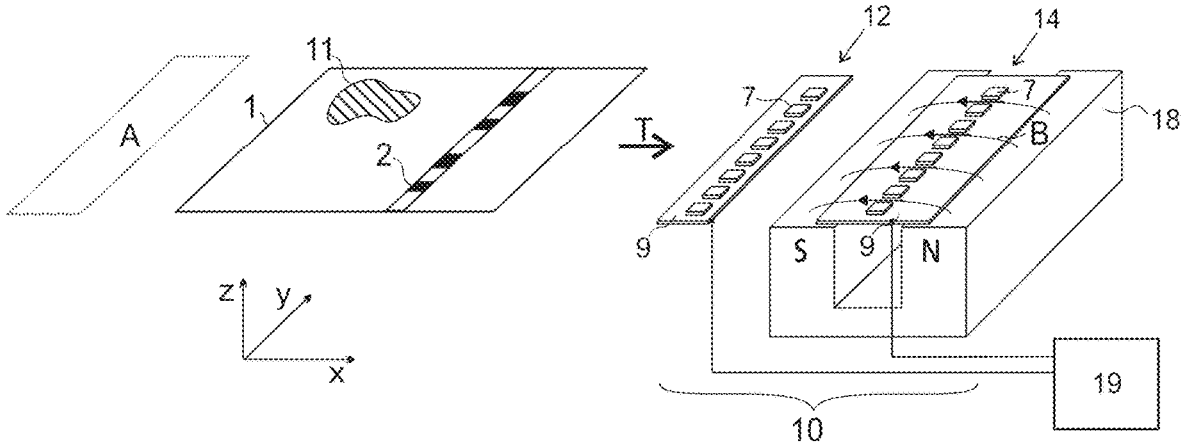

FIG. 2 shows schematically a magnetic sensor 10 of an apparatus for processing value documents, to which the value documents 1 are fed individually or in stacks, subsequently checked, sorted and stored in the apparatus for processing value documents or dispensed again. A value document 1 is transported along a transport path first past a magnetization device which makes available a magnetic field A, and thereafter past a magnetic sensor 10 with two sensor rows 12, 14. Depending on the requirements posed to the magnetic sensor, it can alternatively also have only one of the two sensor rows 12, 14. By the magnetic field A highly coercive and lowly coercive magnetic regions of the value document 1 are magnetized. For example, the magnetic field A points in the transport direction T of the value document 1. However, the magnetic field A can also comprise several sections of different magnetic field direction. The magnetic field A can be, for example, made available by two mutually opposing magnets, between which the value document 1 is transported through and whose north magnetic poles N face each other, so that there results between these a magnetic field A parallel to the transport direction T. For magnetizing, in addition, also a further pair of magnets can be employed, in which the two magnetic south poles face each other, for example to achieve an anti-parallel magnetization of lowly coercive magnetic regions. Alternatively, it is also possible to employ for magnetizing only one magnet arranged on one side of the transport path, as long as a sufficiently large magnetic field strength for magnetizing the value document is obtained thereby. Alternatively, the first magnetic field A can also be made available by a single bar magnet or by a horseshoe magnet analogous to the magnet 18.

The value document 1 has a security element 2 with a magnetic coding. The security element 2 is formed in this example as a security thread having along its longitudinal direction a magnetic coding of magnetic regions 2, between which non-magnetic material is located. These magnetic regions 2 can comprise highly coercive magnetic regions and/or lowly coercive magnetic regions and optionally also combined magnetic regions which contain both highly and lowly coercive magnetic material. Optionally, the value document also has a magnetically soft magnetic region 11 outside the security thread.

After magnetization in the magnetic field A, the value document 1 is transported past the magnetic sensor 10 which is installed in the apparatus for processing value documents so as to be spatially separate from the magnetic field A. The magnetic sensor 10 contains two sensor rows 12, 14 which respectively have a multiplicity of magneto-sensitive measuring sensor elements 7 of the same kind, which are arranged in a row. Each of these measuring sensor elements 7 supplies a magnetic signal, so that in this example a multiplicity of first magnetic signals are detected with the aid of the measuring sensor elements 7 of the sensor row 12 and a multiplicity of second magnetic signals are detected with the aid of the further magneto-sensitive elements 8 of the sensor row 14, which relate to the same section of the security element 2 transported past.

During the detecting of the first magnetic signals, the security element 2 is not subjected to any magnetic field. The magneto-sensitive elements 7 of the second sensor row 14 detect the second magnetic signals of the security element 2 under the action of a second magnetic field B, which acts on the security element 2 before and during the detecting of the second magnetic signals. The second magnetic field B is made available by a permanent magnet 18 arranged on one side of the transport path and has an extension such that it already magnetizes the security element 2 before the latter comes into the capture region of the second sensor row 14. The poles N, S of the magnet 18 are so aligned that there arises in the transport plane a magnetic field B anti-parallel to the transport direction T of the value document. The magnetic field strength of the magnetic field A amounts to, for example, at least twice the magnetic field strength of the magnetic field B. The detecting of the second magnetic signals under the action of the second magnetic field B has the advantage that the second sensor row 14 can be employed not only for detecting the different magnetic regions of the security element 2, but that it can also detect magnetic signals of magnetically soft magnetic regions of the security element 2, which can be present on the value document outside the security element 2.

The measuring sensor elements 7 of each of the sensor rows 12, 14 are each arranged on a common printed circuit board (wiring of the printed circuit boards not shown), and connected to a control and evaluation device 19, which drives the measuring sensor elements 7 and the further sensor elements 8 to detect the magnetic signals and evaluates their magnetic signals. The printed circuit board of the sensor row 14 and the magnet 18 are fixed mechanically to each other by potting so as to form one constructional unit. The control and evaluation device 19 receives magnetic signals from the two sensor rows 12, 14 and processes and analyzes them. The control and evaluation device 9 can be arranged together with the sensor rows 12, 14 in the same housing. Via an interface, data can be sent from the control and evaluation device 19 outside, for example to a device that processes the data further or to a display device that informs about the result of the value document check.

On the lower side of the printed circuit board 9 of the sensor row 12, a plurality of the further sensor elements 8 are arranged in each case, with the aid of whose measuring signal the distance correction according to the invention of the measuring signal of the measuring sensor elements 7 is carried out. In this example, fewer sensor elements 8 than measuring sensor elements 7 are employed, as shown in FIG 1b. Alternatively, however, a corresponding further sensor element 8 can also be present for each measuring sensor element 7 on the back side of the circuit board 9, as shown in FIG 1a. The second sensor row 14 on the lower side of the circuit board 9 is preferably also equipped with further sensor elements 8 in order to be able to carry out a distance correction also for the measuring signal of the measuring sensor elements 7 of the second sensor row 14. Amplifier chips for amplifying the detected measuring signal and correction signal can be arranged on the lower side of the printed circuit boards 9.

Figure 3:
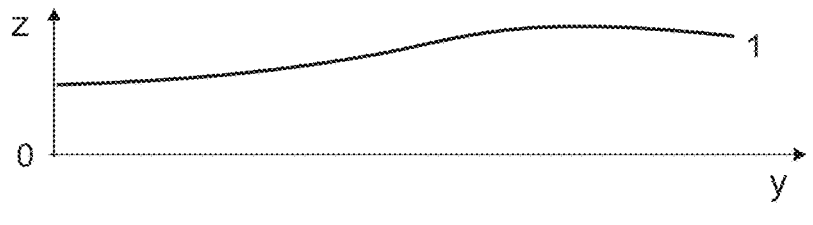

In FIG. 3, by way of example, a value document 1 is shown in a side view (viewing direction in the transport direction), which has an irregular distance to the surface of the measuring sensor elements 7, which is at z=0. In the right region, the value document has a distance to the sensor surface that is almost twice as large as in the left region.

In order to make possible a correction of the distance fluctuations of the value document, the progression of the signals of the measuring sensor elements and of the further sensor elements is ascertained as a function of the value document distance a before the value document check. For this purpose, for example, a value document is successively placed at different distances to an arrangement of one or a plurality of measuring sensor elements and one or a plurality of further sensor elements, said arrangement corresponding to the arrangement of the measuring sensor elements 7 and further sensor elements 8 in the magnetic sensor employed later for the value document check. For each distance a, a measuring signal of the respective measuring sensor element and a correction signal of the respective further sensor element are detected. Both signals show distance dependence, which decreases with increasing distance a of the value document, cf. FIG. 4*a*, wherein M designates the measuring signals of the measuring sensor elements and K designates the correction signals of the further sensor elements. Due to the greater distance a of the further sensor elements 8 from the value document, the correction signals of the further sensor elements 8 are always below the measuring signals of the measuring sensor elements 7. The measuring signals of FIG. 4*a* were normalized to a nominal target distance d of the value document from the measuring sensor elements of 1 mm.

Subsequently, the ratio of the signals shown in FIG. 4*a* (quotient M/K) is formed for the various value document distances a. This results in the dependence of the value document distance a shown in FIG. 4*b* from the ratio K/M of the measuring signals M of the measuring sensor elements 7 to the correction signals K of the further sensor elements 8. The dependence shown in FIG. 4*b* can be stored in the control and evaluation device 19 of the magnetic sensor as a function or as a look-up table.

The distance correction will be explained in the following using the example of the measuring signals detected by the first sensor row 12 from the security thread of the value document 1, with which the magnetization of the value document 1 without external magnetic field is detected, but is equally applicable to a distance correction of the measuring signals of the sensor row 14, which detects the magnetization of the value document 1 in the magnetic field. However, the distance correction described in the following is also suitable for other types of magnetic security elements of value documents, for example for a motif or partial motif of magnetic printing ink.

Figure 5A:
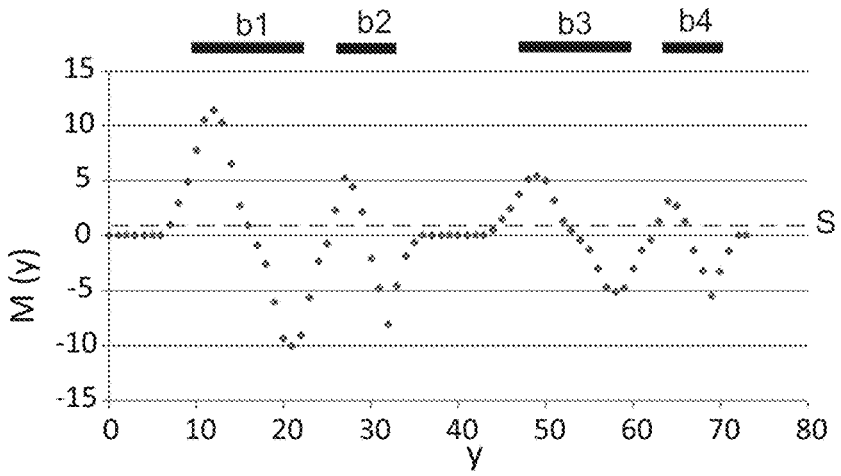
FIG. 5*c* the measuring signal of the value document corrected with the aid of the correction signal, FIG. 6*a* the ratio of the correction signal to the measuring signal at specific y-positions, FIG. 6*b* progression of the distance from the measuring sensor row ascertained for the value document, FIG. 6*c* correction factor ascertained from the distance of FIG. 6*b* and the signal progression of FIG. 4*a* as a function of the position y.
Figure 5B:
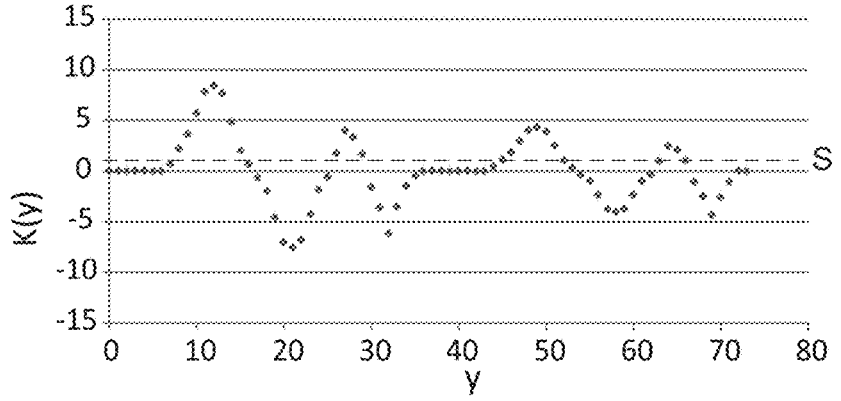

FIG. 5 a shows, by way of example, the measuring signal of the sensor row 12, detected by the same from a magnetic security element which has a plurality of magnetic regions b1, b2, b3 and b4 along a direction designated by y. The arrangement of the magnetic regions along the security element (along the y-direction) is sketched above the diagram in FIG. 5*a*. The measuring signal represented in FIG. 5*a* was detected by a multiplicity of measuring sensor elements 7 which are arranged along the y-direction. For example, these are the measuring signals of the measuring sensor elements 7 detected at a specific point in time, while the value document equipped with this security element is transported past the magnetic sensor. As a function of the position coordinate y, in this example each magnetic region b1-b4 supplies a measuring signal in the form of a double peak. FIG. 5*b* shows the corresponding correction signal detected by the further sensor elements 8 arranged behind the measuring sensor elements 7 from the magnetic regions b1-b4 of this security element at the same measuring time. The double peaks of the correction signals are lower than those of the measuring signals of the measuring sensor elements 7, corresponding to the greater distance of the further sensor elements 8 from the value document. To quantify the measuring signals and the correction signals, for example, the maximum of the double peak is determined, and this maximum value is employed for the further evaluation as a measuring signal M or correction signal K. Alternatively, however, it is also possible to employ respectively the peak-to-peak amplitude of the double peaks or the height of only one of the peaks or the area under one or both peaks of the double peak.

Figure 6A:
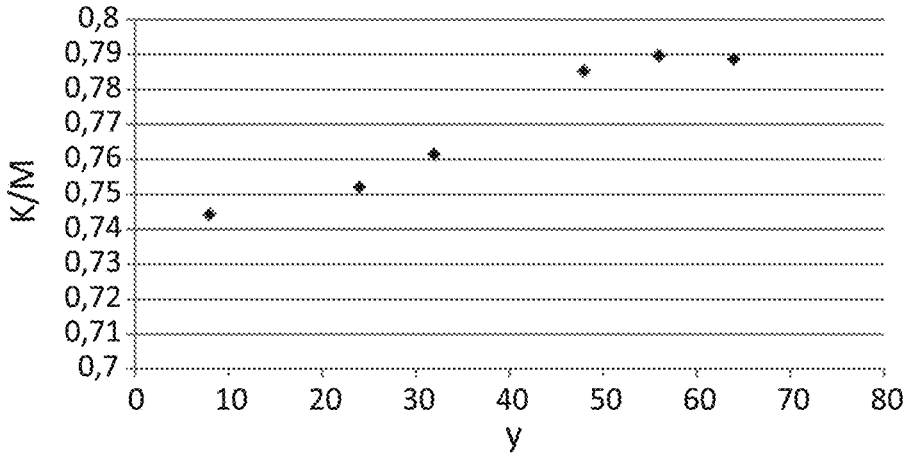

In order to determine a correction function F(y) for the measuring signal M of FIG. 5*a*, the respective correction signal K is compared with the respective measuring signal M of the measuring point for the measuring points along the y-direction, for example by forming the ratio. FIG. 6*a* shows the ratio of these signals as a function of the position coordinate y for those measuring points at which both a measuring signal M and a correction signal K were detected. Since the number of further sensor elements 8 is smaller than the number of measuring sensor elements 7, and thus both signals are present only for a few measuring points, the ratio formation is limited to those measuring points along the y-direction for which a correction signal was actually detected as well.

However, the ratio is preferably formed only for such measuring points or sensor elements which supply a clear measuring signal, for example whose measuring signal is above a certain threshold S. For example, the threshold of S=1 drawn in FIGS. 5*a* and 5*b* is employed for this purpose. Measuring points at which the measuring signal of the respective measuring sensor element 7 or the correction signal of the respective further sensor element 8 are below the threshold S=1 are ignored for the ratio formation and the subsequent distance correction, for example the measuring points in the region y=40, in which according to FIG. 5*a*, no magnetic region is present. This avoids a possibly erroneous distance correction, which can lead to strongly falsified values.

Figure 6B:
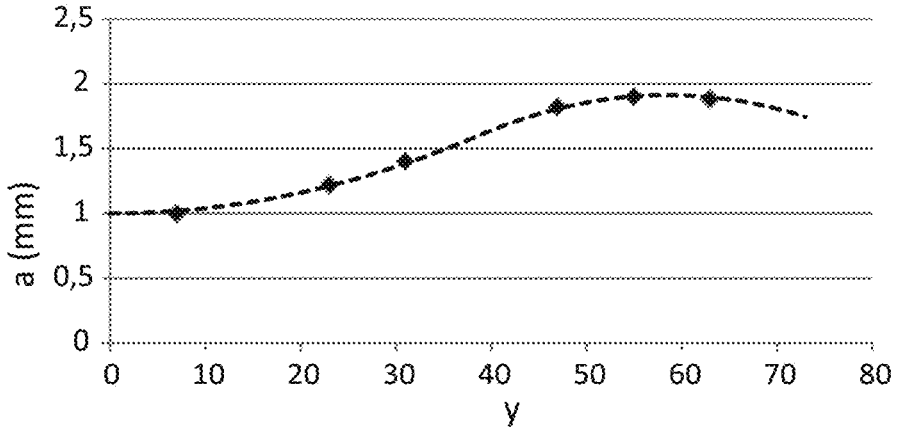

From the ratios shown in FIG. 6*a*, the distance of the value document from the measuring sensor elements 7 at the respective y-position is determined for each of the y-positions chosen in this way. For this purpose, the ratio at the respective y-position is converted into a distance on the basis of the relationship between ratio and distance ascertained before the value document check, as shown in FIG. 4*b*. FIG. 6*b* shows the progression ascertained in this manner of the local distance of the respective measuring point of a value document from the measuring sensor elements 7 for the chosen y-positions. In addition, a fit function adjusted thereto is drawn in, which has a continuous progression, and is employed to determine the value document distance for each of the measuring sensor elements 7 (thus also including those whose y-position was not chosen).

Figure 4A:
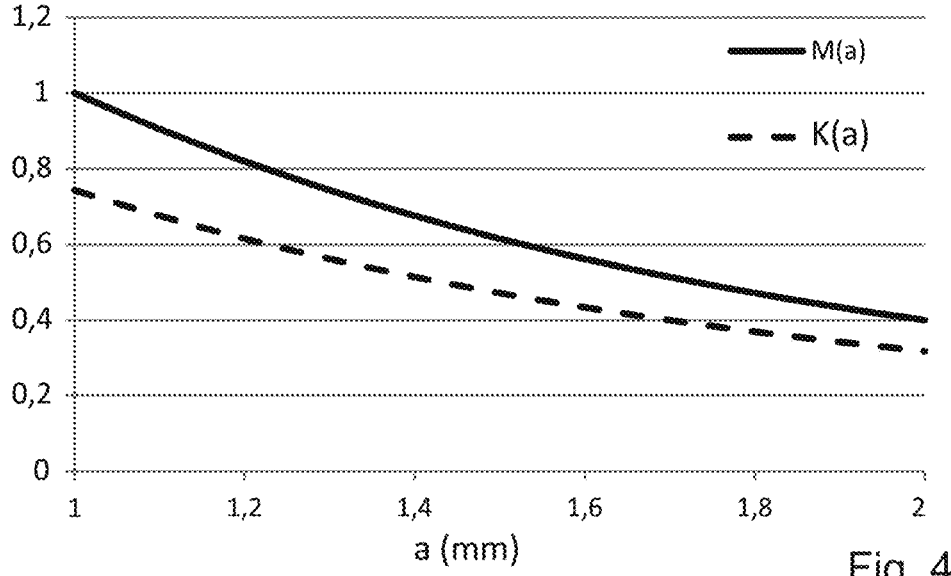
Figure 4B:
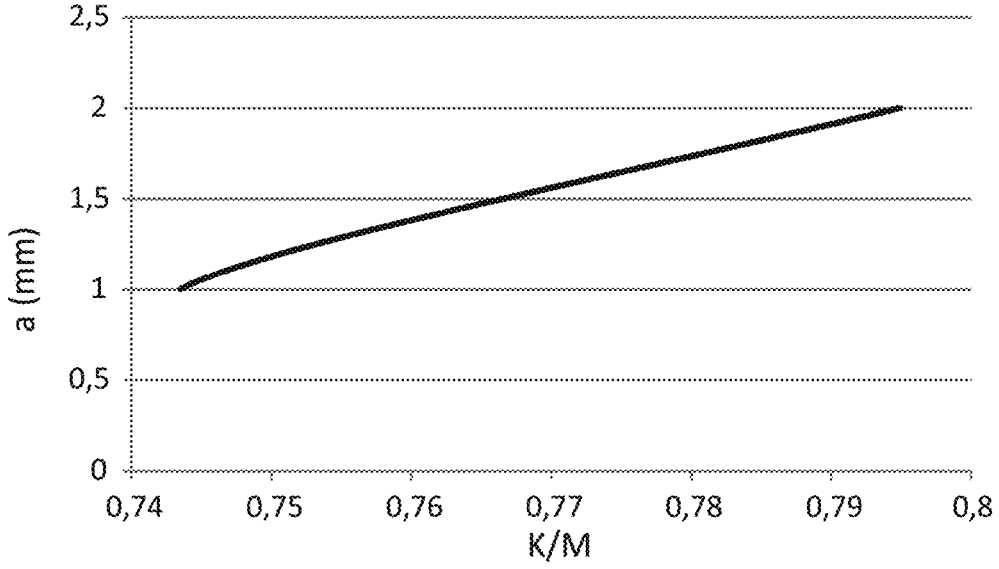
Figure 6C:
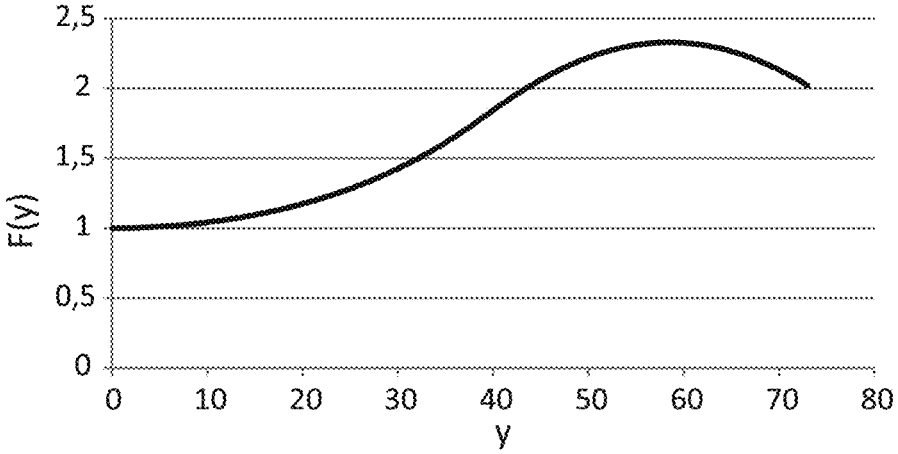

By integrating the actual distance values of the value document shown in FIG. 6*b* into the distance dependence of the expected measuring signal of FIG. 4*a* ascertained before the value document check, a specific factor results for each y position by which the measuring signal of the respective measuring sensor element is falsified due to the actually ascertained distance. For example, in the region y=55, where an actual value document distance of approximately 1.9 mm was ascertained, there results, on the basis of the distance dependence of the measuring signal of FIG. 4*a* ascertained before the value document check, a measuring signal that is reduced by a factor of approximately 2.3 in comparison to the distance y=1 (corresponding to a proportion of about 43%, cf FIG. 4*a*). For a distance correction, the measuring signal at y=55 is therefore to be multiplied by a correction factor of 2.3. In this manner, the correction function F(y) shown in FIG. 6*c* is ascertained, which indicates this correction factor F for each individual y-position.

Figure 5C:
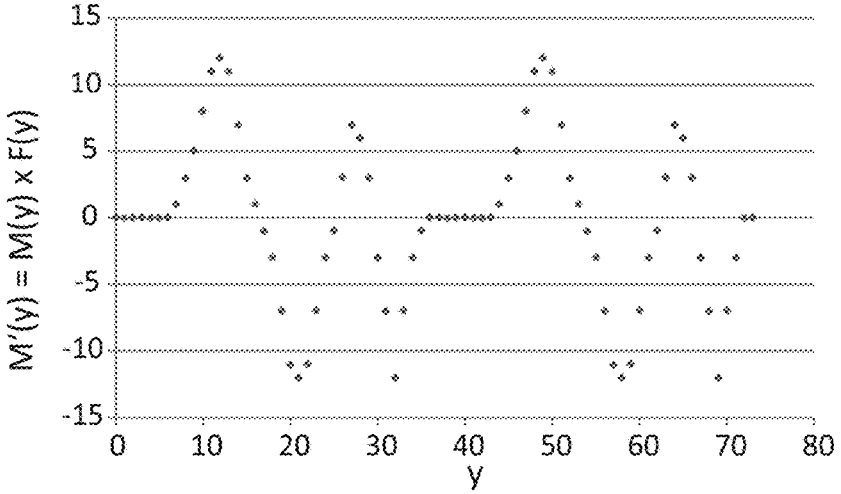

For distance correction, the measuring signal M(y) of FIG. 5*a* detected from the magnetic regions b1-b4 by the measuring sensor elements 7 is multiplied with the correction function F(y). The result of this correction is represented in FIG. 5*c*. Due to the standard spacing of a=1 mm defined before, through this correction the measuring signal is obtained which would be expected from the value document if it were transported past all y-positions at the ideal standard distance of 1 mm. In comparison to the actually detected measuring signal of FIG. 5*a*, in which the left double peak of the magnetic region b1 is significantly higher than the right three double peaks, the distance correction carried out leads firstly to the double peaks of the two long magnetic regions b1 and b3 being matched to one another and secondly to the double peaks of the two short magnetic regions b2 and b4 also being matched to one another. The corrected measuring signal is subsequently employed to check the value document. In particular, a magnetic coding of a security element of the value document can thus be checked or the magnetic imprint of a value document can be checked. To check the value document, the corrected measuring signal is compared, for example, with a measuring signal expected for the security element. The result can be employed, for example, in the context of a quality check or an authenticity check of the value document or to determine the identity of the value document.

The invention claimed is:

1. A method for checking the magnetic properties of a value document, having the following steps of:

transporting a value document past a magnetic sensor along a transport direction, wherein the magnetic sensor has, transverse to the transport direction of the value document, a measuring sensor row with a plurality of magneto-sensitive measuring sensor elements, which are arranged at a target distance to a transport plane of the value document, and wherein the magnetic sensor has at least one further magneto-sensitive sensor element, which, viewed from the value document transported past, is arranged behind the measuring sensor row and has a greater distance from the transport plane of the value document than the measuring sensor elements, detecting measuring signals of the value document by the measuring sensor elements at a plurality of measuring points of the value document, which is arranged on the value document along a measuring line transversely to the transport direction, detecting a correction signal by at least one of the further sensor elements at at least one correction measuring point of the value document, ascertaining corrected measuring signals of the measuring points by correcting the measuring signals detected at the measuring points with the aid of the correction signal detected at at least one correction measuring point, checking magnetic properties of the value document on the basis of the corrected measuring signals of a plurality of measuring points.

2. The method according to claim 1, wherein the following steps are carried out for correcting the measuring signals detected at the measuring points of the value document:

comparing the respective measuring signal of a measuring point with a correction signal ascertained for the measuring point and ascertaining a distance of the respective measuring point of the value document from the respective measuring sensor element on the basis of a signal drop which the correction signal ascertained for the measuring point has in comparison to the measuring signal of the respective measuring point, correcting the respective measuring signal detected by the respective measuring sensor element at the respective measuring point with the aid of the ascertained distance of the value document from the measuring sensor element making use of a known distance dependence of the measuring signal of the measuring sensor elements.

3. The method according to claim 2, wherein the measuring signal of the measuring sensor elements is corrected upward, if the ascertained distance exceeds the target distance, and is corrected downward, if the ascertained distance undershoots the target distance, and the dimension of the correction depends on the ratio of the respective measuring signal of a measuring point to the correction signal ascertained for the measuring point.

4. The method according to claim 2, wherein for correcting the respective measuring signal, the distance ascertained for the respective measuring point is inserted into a known distance dependence of the measuring signal of the measuring sensor elements, in order to ascertain a correction factor that is applicable to the respective measuring point and that is offset against the measuring signal of the respective measuring point.

5. The method according to claim 1, wherein the correction signals of the correction measuring points are detected simultaneously with the measuring signals of the measuring points.

6. The method according to claim 1, wherein the number of further sensor elements is at least two, but in particular is smaller than the number of measuring sensor elements, and the measuring signal of the measuring points of such measuring sensor elements, behind which no further sensor element is arranged, is corrected with the aid of the correction signals of at least two correction measuring points, in particular with the aid of the two correction measuring points most closely adjacent to the measuring point.

7. The method according to claim 6, wherein, for correcting the measuring signal of the measuring sensor elements, behind which no further sensor element is arranged, the correction signals of the further sensor elements or values derived from these correction signals are interpolated.

8. The method according to claim 1, wherein the correction of the detected measuring signals is carried out only for such measuring signals of the measuring sensor elements which reach or exceed a predetermined threshold.

9. The method according to claim 1, wherein during the transport of the value document past the magnetic sensor, the measuring signals of measuring points of a two-dimensional section of the value document are detected, said section extending both transversely to the transport direction and along the transport direction, and that the measuring signals of the measuring points of the two-dimensional section are compared with a predetermined threshold and that for such measuring points whose measuring signal undershoots the predetermined threshold, the measuring signal is corrected with the aid of the correction signals of at least two, preferably at least three, correction measuring points the two-dimensional section, which correction measuring points are shifted along the transport direction with respect to the measuring points, and optionally additionally corrected with the aid of the correction signal of one or a plurality of correction measuring points of the two-dimensional section, which are shifted transversely to the transport direction with respect to the measuring points.

10. The method according to claim 9, wherein from the correction signals of two or more than two correction measuring points for the two-dimensional section overall an average distance is ascertained which the two-dimensional section has from the measuring sensor elements, and the measuring signals of all measuring points of the two-dimensional section are corrected with the aid of the average distance of the two-dimensional section.

11. The method according to claim 10, wherein one of the correction measuring points employed for ascertaining the average distance—viewed in the transport direction of the value document—is disposed at the beginning of the two-dimensional section and a further correction measuring point is disposed at the end of the two-dimensional section.

12. A magnetic sensor for checking magnetic properties of a value document, which is transported past the magnetic sensor in a transport plane along a transport direction, comprising a measuring sensor row arranged transversely to the transport direction of the value document, which has a plurality of magneto-sensitive measuring sensor elements arranged at a target distance to the transport plane of the value document, at least one further magneto-sensitive sensor element which, with reference to the value document transported past, is arranged behind the measuring sensor row and is arranged along a line parallel to the measuring sensor elements and has a greater distance from the transport plane of the value document than the measuring sensor elements, wherein a control device adapted to control the measuring sensor row that the measuring sensor elements detect measuring signals of the value document at a plurality of measuring points of the value document, said measuring points being arranged on the value document along a measuring line transversely to the transport direction, and to control the at least one further sensor element that it detects at least one correction signal at at least one correction measuring point of the value document, an evaluation device adapted to correct the measuring signals detected at the measuring points of the value document with the aid of the correction signal detected at the at least one correction measuring point of the value document, thereby to eliminate the distance dependence of the measuring signals and to check the magnetic properties of the value document on the basis of the corrected measuring signals of a plurality of the measuring points.

13. The magnetic sensor according to claim 12, wherein the measuring sensor elements and the at least one further sensor element are arranged on the mutually opposing sides of the same carrier.

14. An apparatus for checking magnetic properties of a value document, comprising:

a transport device for transporting the value document in a transport plane along a transport direction, a magnetic sensor according to claim 13.

15. The magnetic sensor according to claim 12, wherein the magnetic sensor has a plurality of further sensor elements, which are arranged along a line perpendicular to the transport direction of the value document, wherein the density of the further sensor elements of the magnetic sensor perpendicular to the transport direction of the value document is chosen in particular such that the magnetic sensor has at least one further sensor element for each 20 mm section of the value document perpendicular to the transport direction of the value document.

* * * * *